United States Patent [19]

Brooks et al.

[11] 4,427,039

[45] Jan. 24, 1984

[54] MECHANICAL DELIVERY SYSTEM FOR A CATALYST OR THE LIKE

[76] Inventors: William R. Brooks, 260 Arlington, Elmhurst, Ill. 60126; Irving C. Heinzel, 45 Brookdale La., Palatine, Ill. 60067

[21] Appl. No.: 330,574

[22] Filed: Dec. 14, 1981

[51] Int. Cl.[3] ..... B65B 3/04

[52] U.S. Cl. ..... 141/20; 141/94; 141/329; 222/386

[58] Field of Search ..... 141/3, 20, 19, 329, 141/330, 94; 604/209, 208, 210, 211, 411; 222/386, 391

[56] References Cited

U.S. PATENT DOCUMENTS 3,096,001 7/1963 Boe et al. ..... 222/135

3,295,724 1/1967 Brooks et al. ..... 222/80

*Primary Examiner*—Houston S. Bell, Jr.

*Attorney, Agent, or Firm*—John S. Fosse

[57] ABSTRACT

This invention concerns apparatus for injecting a special ingredient into a pre-filled product container having superatmospheric internal pressure. Structurally, a coupling member is fabricated to define a cavity that snugly receives a portion of the container body to establish alignment therewith. This coupling member includes a mounting structure for use in positioning a syringe assembly with respect to a pierceable portion of the container body. A syringe assembly includes a syringe body that is mounted on the mounting structure and defines an internal chamber for containing a metered amount of a fluid product ingredient or amendment, the syringe assembly further including a cannulated needle fastened to the syringe body in fluid-transfer relationship with the product ingredient chamber. A wrench member is assemblable with the coupling member and includes an actuator for selectively engaging the syringe assembly and forceably reducing the internal volume of the product ingredient chamber. Force-multiplying mechanical arrangements are arranged to act between the coupling member and the wrench member for urging the actuator to express the contents of the ingredient chamber through the needle and into the product container against its internal pressure.

12 Claims, 4 Drawing Figures

MECHANICAL DELIVERY SYSTEM FOR A CATALYST OR THE LIKE

FIELD OF THE INVENTION

This invention relates in general to portable, self-contained apparatus for the pressurized dispensing of reactable resin systems and the like. The invention relates more particularly to mechanical schemes for introducing such things as an active ingredient or an activating substance into a pressurized chemical system at the time of use; and in one specific aspect, the present invention relates to a catalyst injection device for use with pressure-dispensable synthetic resin systems.

BACKGROUND OF THE INVENTION

In the past, paints, lacquers, adhesives, insulating resinous foams and kindred products have been specially formulated for spray application from hand-held, pressurized containers of the "aerosol" type. However, many of these products have been compromised from their optimum properties by the special formulation requirements for this mode of utilization. Other products have resisted successful re-formulation altogether. Furthermore, a primary concern in the formulation of polymerizable, reactable, or curable products for "aerosol" dispensing is the assurance of adequate shelf-life or pot-life in the container; and the desire to achieve commercially acceptable storage-life has heretofore involved such approaches as the provision of two separate containers for the reactable components, in conjunction with individual valving and a common mixing nozzle. Boe et al U.S. Pat. No. 3,096,001 discloses such an arrangement. Another approach relies on a selectively rupturable, partition membrane, such as is taught in Brooks et al U.S. Pat. No. 3,295,724. Both of these systems are prone to produce generally unacceptable variation from the targeted stoichiometric proportion of the various ingredients and concomitant unpredictability in the performance of the resultant product.

In addition, a particularly critical shelf-life problem exists with aerosol-packaged pre-polymerized urethane products because of the propensity that these compositions display for progressive enviscosation and ultimate solidification upon prolonged storage, especially when packaged with cure-accelerators or with reactive blowing agents. Formulation of such products so as to realize, in the cured state, the optimum combination of strength, toughness and rigidity, as a consequence, has resulted in drastically abbreviated shelf-life.

SUMMARY OF THE INVENTION

The present invention overcomes the limitations of the prior art by providing a mechanical scheme which includes means for hydraulically introducing, at the time of intended use, a selected amount of a catalyst fluid, or the like, into a filled aerosol dispenser and against the normal backpressure of the compressed propellant gas. By means of the present invention, the introduction of such an activating substance or active ingredient is reserved until immediately prior to actual utilization of the container/dispenser. Hence, the main body of product can be formulated to exhibit an extended shelf-life without experiencing any substantial deterioration. The injection system of the instant invention also provides means for integral, leakproof storage of a catalyst fluid or the like.

Therefore, a general object of the present invention is to provide a new and improved mechanical system for injecting a small, metered quantity of a special product ingredient into a previously filled, pressurized container/dispenser.

Achievement of this broad object and other, more specific objects and features of the invention will become apparent from a consideration of the following descriptions.

BRIEF DESCRIPTION OF THE DRAWING

In order that the principles of the invention may be readily understood, a single embodiment thereof, applied to a self-contained, prepolymer polyurethane foam dispensing system, but to which the application is not to be restricted, is shown in the accompanying drawings wherein.

DETAILED DESCRIPTION OF THE INVENTION

Figure 1:
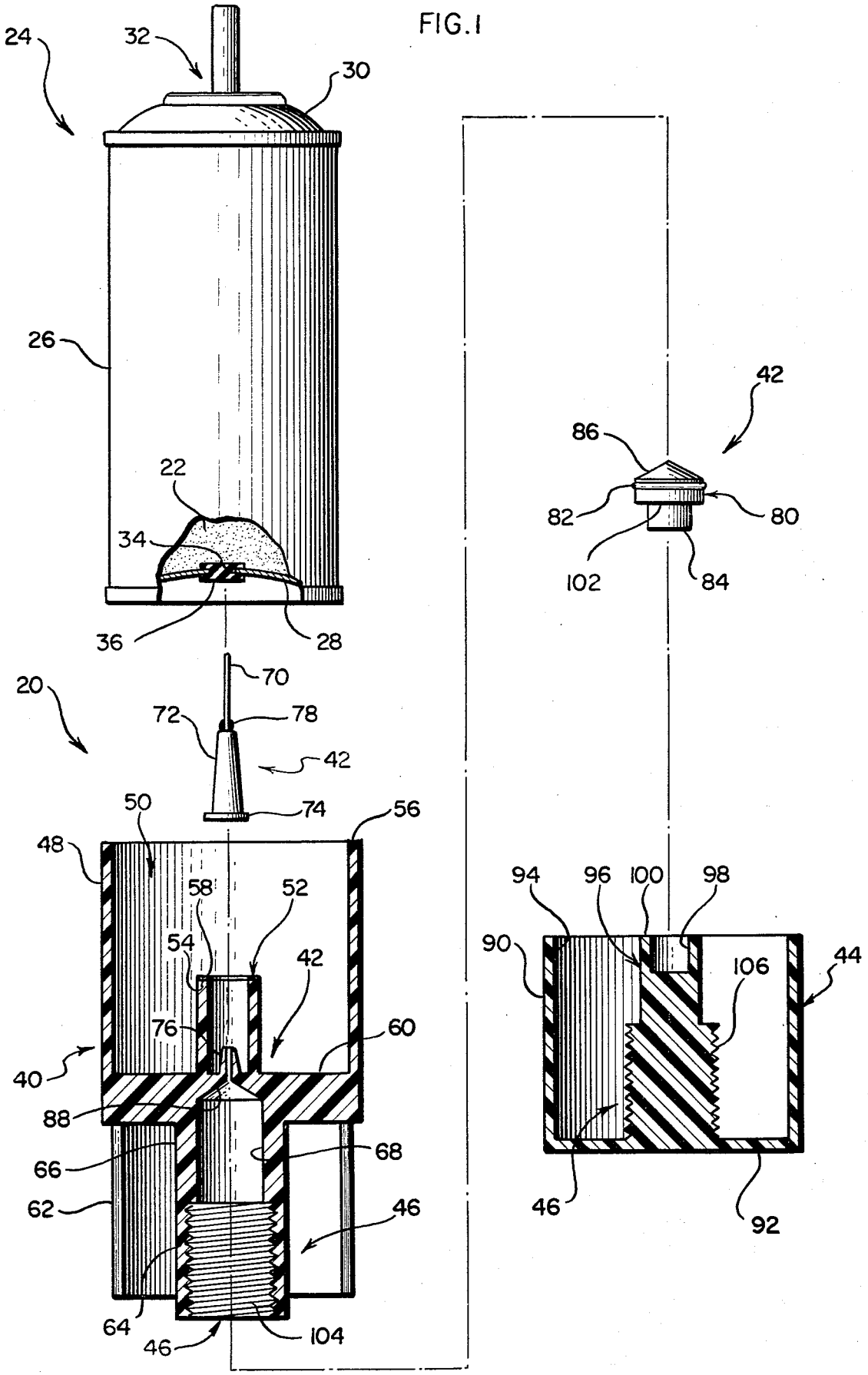
FIG. 1 is an exploded side-view, partially in elevation and partially in cross-section, showing injector apparatus constructed in compliance with the present invention and illustrated in conjunction with a pre-filled polyurethane foam container/dispenser.

Referring now in detail to the drawings, specifically to FIG. 1, injector apparatus indicated generally by the reference numeral 20 is shown arranged for introducing a fluid product ingredient, such as a liquid catalyst or activator for example, into a chemically reactable product mass 22 previously filled into an aerosol container/-dispenser 24, the container/dispenser 24 being designed for safely packaging the superatmospheric internal pressure of about 40 to 100 pounds per square inch which is conventionally employed to keep a propellant gas or the like in a substantially liquified state at ambient temperature. When the product mass 22 comprises a urethane prepolymer or polymer precursor, the superatmospheric internal pressure, to serve as both propellant and blowing agent, is advantageously provided by means of a charge of dichlorodiflouromethane and the product ingredient that is introduced using the injector apparatus 20 comprises a liquid catalyst for the polymer system.

The container/dispenser 24 generally includes a tubular metallic body 26, a concave bottom 28 and a domed top 30 which is equipped with a dispensing valve arrangement 32, the bottom 28 and the top 30 being hermetically seamed to the opposite ends of the body 26 or drawn integrally therewith. In order to cooperate with the injector apparatus 20 in the introduction of the special product ingredient or amendment, the bottom 28 of the container/dispenser is preforated with a central aperture 34 which, in turn, is sealed with a pierceable, resilient gasket or elastomeric grommet 36 of generally spool-like configuration.

The injector apparatus 20 comprises a mediately disposed coupling member 40, a syringe assembly 42, a wrench member 44, and a force-multiplying arrangement 46 which acts between the coupling member 40 and the wrench member 44 in operating the syringe. Advantageously, the coupling member 40 and the wrench member 44 are fabricated from a relatively chemically inert resinous plastic material, such as polypropylene, in a conventional injection molding procedure.

The coupling member 40 comprises an outer, tubular, grippable wall formation 48 which defines a central caity 50, cavity 50 being shaped and dimensioned for snug, slidable reception of the bottom portion of the container/dispenser body with the grommet 36 facing inwardly of the cavity. Close fit of the container/dispenser within the cavity 50 establishes a datum axis aligned through the center of the grommet 36 for purposes which will be described more fully hereinafter. The coupling member 40 also includes a tubular stop structure 52 that is arranged to be coaxial with the outer tubular wall formation 48; and the stop structure 52 terminates at its free end in a lip 54 which is confrontable with the exterior surface of the concave container bottom 28 encompassing the grommet 36 to define a mechanical stop. Accordingly, the end lip 54 is spaced axially inwardly from an annular edge 56 of the outer tubular wall formation 48; and desirably, the end lip 54 is covered with a ring 58 of gasket material which acts as a seal and as a bumper. The material of gasket 58 may be a latex composition, a hot melt elastomer or a pre-cut resilient washer.

The coupling member 40 is also fashioned with an annular imperforate floor 60 disposed between the outer wall formation 48 and the stop structure 52; and a hollow cylindrical guide sleeve 62 is arranged coaxially with the tubular wall formation 48 extending axially beyond the floor 60 in the opposite direction from the stop structure 52 to couple telescopingly with the wrench member 44. A tubular stem 64 depends from the floor 60 within the guide sleeve 62 in order to embody portions of both the syringe assembly 42 and the force-multiplying arrangement 46.

Figure 2:
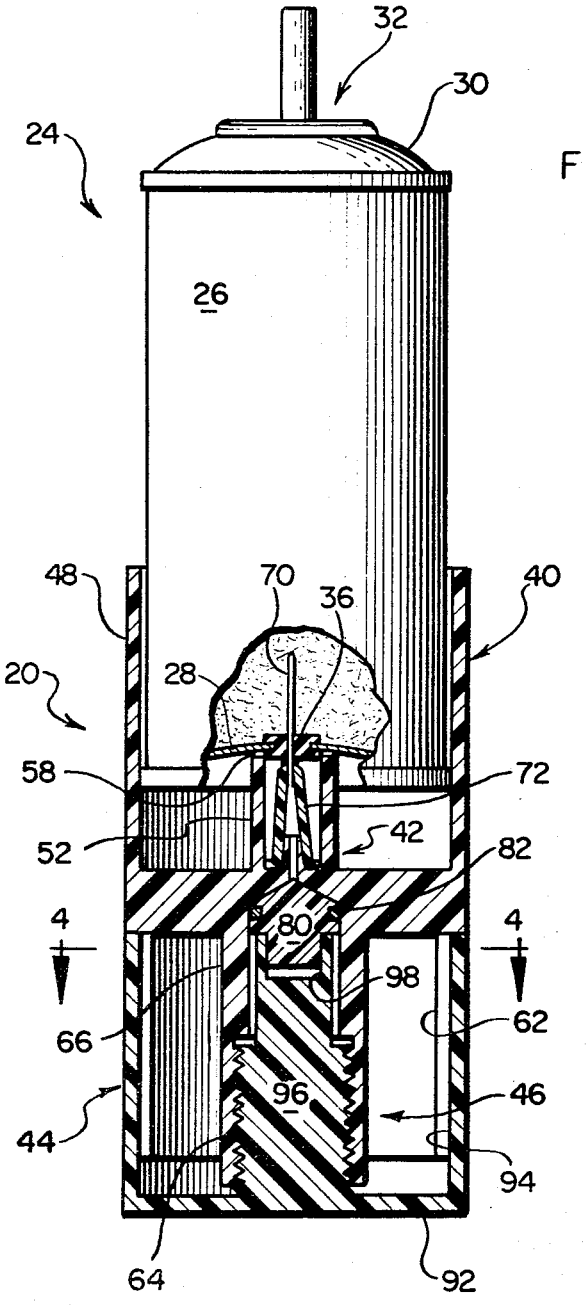
FIG. 2 is a side view in partial section showing the various components of the injector apparatus of FIG. 1 assembled and connected to inject a special product ingredient into the pressurized container/dispenser.

The floor 60 and the stem 64 cooperate to define a mounting arrangement for the syringe assembly 42. Specifically, the syringe assembly 42 includes a tubular barrel 66 that is fabricated as an integral part of the stem 64, barrel 66 defining an internal, cylindrical chamber 68 for containing a metered quantity of a liquid product ingredient, such as a catalyst. The syringe assembly 42 also includes a cannulated needle 70 fastened to the tubular barrel 66 in fluid-transfer relationship with the product ingredient chamber 68, particularly by means including a nipple 72 fabricated with a radially outwardly extending bottom flange 74. The barrel 66 includes a tapered, hollow pin 76 upstanding from the floor 60 within the tubular stop structure 52; and the nipple 72 is hollowed taperedly to press-fit over the pin 76 with the flange 74 seated on the floor 60, is shown in FIG. 2. A solvent or fusion joint usefully secures the attachment of the flange to the floor; and in addition, a small body 78 of structural adhesive or cement is used in fastening the needle 70 to the nipple 72. It will be appreciated that the pin 76 is located centrally of the stop structure 52 in order to align the needle 70 axially with the center line of the grommet 36 in pierceable relationship therewith. A safety overcap, not shown, may be provided for the needle 70, if desired.

The syringe assembly 42 additionally includes a generally cylindrical piston 80 which is movably disposed in the product chamber 68 for use in expressing the special product ingredient from the barrel of the syringe assembly, through the needle 70 and the gasket 36, and into the product mass 22 within the container/dispenser 24. Advantageously, a toroidal sealing gasket 82 is seated in an annular groove provided in the outer wall of the cylindrical body of the piston 80 to afford leakproof confinement of the liquid product ingredient. An actuator stem 84 of lesser diameter than the cylindrical body of the piston extends from that body in the direction away from an upper conical tip portion 86. In order to cooperate with the conically tipped piston 80 in ensuring complete discharge of the liquid product ingredient from the syringe, the chamber 68 is fashioned with a correspondingly conically shaped end portion 88.

Figure 4:
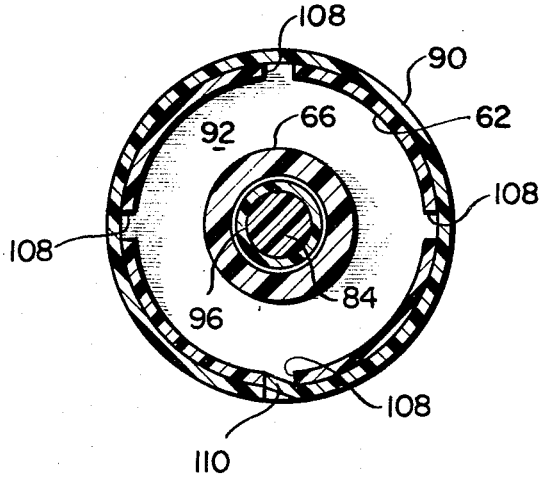
FIG. 4 is a cross-sectional view taken along the line 4—4 of FIG. 2 and showing interengagement of the slots and pawl tooth of the tamperproof construction.

Continuing with reference to FIG. 1, the wrench member 44 comprises an outer, grippable tubular wall 90 which is closed by a transverse end plate 92 and which is provided with a substantially uninterrupted inner cylindrical surface 94, surface 94 slidably and rotatably receiving the guide sleeve 62 upon assembly of the members 40 and 44 to ensure smooth functioning of the force-multiplying arrangement 46. In addition, an actuator post 96 arises from the end plate 92 to present an open bearing recess 98 to the actuator stem 84 of the movable piston 80 for rotatable assembly therewith, as is shown in FIGS. 2 and 4. The post 96 terminates in an annular anti-friction end surface 100 which cooperates with an annular anti-friction shoulder 102 surrounding the piston stem 84 in facilitating relative rotation between the wrench member 44 and the piston 80 as the wrench member is twisted to cause the piston to advance in the product ingredient chamber 68 of the syringe barrel 66.

In accordance with a feature of the present invention, the force-multiplying arrangement 46 acts between the wrench member 44 and the coupling member 40 for causing the actuator post 96 to advance into operative engagement with the piston 80 so as to express the contents of the product ingredient chamber 68 through the needle and into the container/dispenser against the internal backpressure thereof. Structurally, the force-multiplying arrangement 46 comprises an inside screw thread 104 rising helically upwardly from the open end of the tubular barrel 66 of coupling member 40 and an outside screw thread 106 wrapped on the cylindrical base of post 96. The screw threads 104 and 106 are selected to be of cooperative pitch, depth of thread and other salient characteristics so that they may be threadedly interengaged in order that relative twisting of the wrench member 44 will act to converge that member and the coupling member 40.

In accordance with another feature of the invention, tamperproof means are positioned to act between the wrench member 44 and the coupling member 40 to resist and provide a visual indication of any unwanted reversing out of the wrench member relative to the coupling member; and in this regard, the guide sleeve 62 is provided with a suitable number of equidistantly spaced, longitudinal slots 108. Cooperatively, the tubular wall 90 of the wrench member is fashioned with one or more inturned pawls 110 as is well shown in FIGS. 3 and 4. Upon advancing of the screw threads 104 and 106 into mutual engagement, the tooth or pawl 110 will ratchet easily over the slots 108. Attempts to twist the wrench member 44 in the opposite rotational direction relative to the coupling member 40 results in the pawl 110 lodging in one of the slots 108, as is illustrated in FIG. 4, obstructing further reverse relative rotation. As a result, the superatmospheric pressure within the container/dispenser 24, even if it is accidentally manifested through the needle 70 and into the product chamber of syringe barrel 66, is unable to result in blow-back of the special product ingredient once the coupling member and wrench member have been initially engaged.

The application of excessive reversing force can snap or break-off the pawl 110; and the absence of this part thus affords visual indication of damage or tampering with the injector apparatus, warning of a potentially inoperative state.

Figure 3:
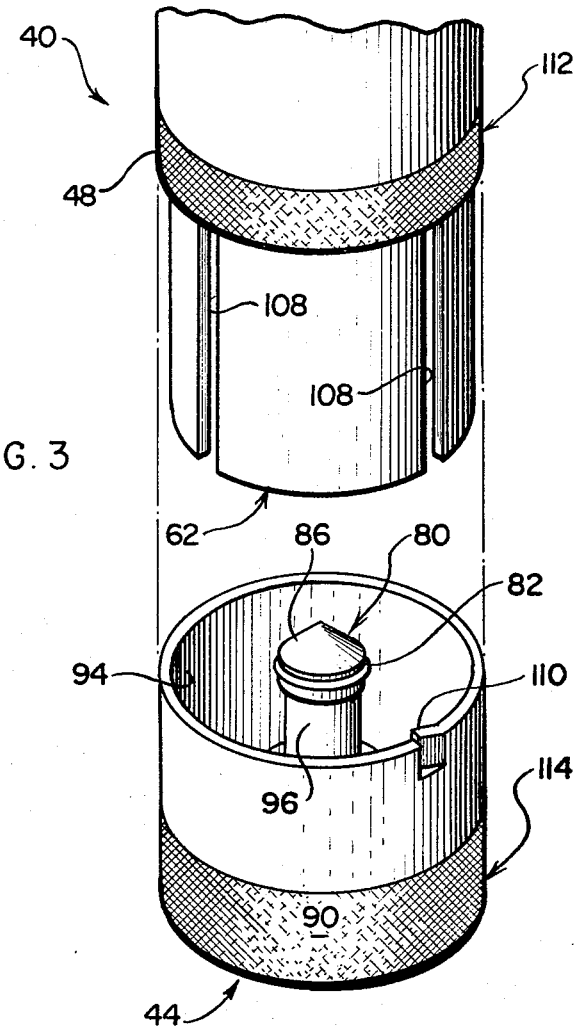
FIG. 3 is an enlarged fragmentary perspective view showing the tamperproof feature which acts between the coupling member and the wrench member of the instant injector apparatus.

In order to facilitate twisting or turning of the wrench member 44 into threaded, force-multiplying engagement with the coupling member 40, knurling 112 is provided on the exterior surface of the coupling wall 48; and cooperative knurling 114 is incorporated on the exterior surface of the wrench wall 90, as is shown in FIG. 3. Accordingly, the coupling member 40 may be readily gripped in one hand and the wrench member 44 gripped in the other hand for relative twisting of the parts for actuating the syringe assembly 42. Knurling 112 and 114 may take the form of cross-hatching, longitudinal ribbing or other forms of grip-enhancing knurling.

For purposes of affording a more complete understanding of the invention, it is advantageous now to provide a functional description of the mode in which the component parts cooperate.

In order to prepare the equipment for discharging an incipiently reacting polyurethane foam mixture, the container/dispenser 24 will have been filled in advance with a selected polyurethane prepolymer or precursor system, together with an appropriate propellant. In addition, the product ingredient injector 20 will have had its syringe chamber 68 charged with a carefully measured amount of a selected catalyst liquid for chemically activating the polyurethane system. As will be appreciated, the syringe needle 70 will have been secured in place in the stop structure 52 by means including the nipple 72, and the piston 80 will have been installed in the syringe barrel and the gases in advance of the piston expelled. The injector 20 will also have been prepared for use by turning the externally threaded post 96 into the internally threaded barrel 66 until the piston stem 84 is telescoped into the bearing recess 98 with the anti-friction surfaces 100 and 102 lightly engaged.

To drive the needle 70 through the gasket 36, the operator will manually grip the container/dispenser 24 in one hand and the assembled injector apparatus 20 in the other, forcing the respective parts longitudinally together, impulse forces being directed against the end plate 92 and along the datum axis which is defined by the gasket 36, the needle 70, the stop structure 52, and the syringe barrel 66. Internal pressure forces from the container/dispenser 24 are precluded from blowing back through the cannulated needle by means of the mechanical advantage obtained from the force-multiplying arrangement 46.

After the stop structure 52 is seated against the surface of the container bottom 28, the wrench member 44 will be manually twisted relative to the coupling member 40 to advance the threads 104 and 106 into progressive interengagement, the external knurling 112 and 114 facilitating this twisting action. In addition, the pawl 110 will ride over the several slots 108 in a ratcheting action, further preventing backing out of the interengagement of the threads.

This twisting action will be continued until the operator can feel the resistance of the conical piston tip 86 bottoming out in the conical end portion 88 of the syringe chamber, signaling the complete discharge of the catalyst liquid into the container/dispenser 24, the parts being shown in this fully seated configuration in FIG. 2.

After the catalyst has been injected, the apparatus 20 will be pulled away from the container/dispenser 24 to withdraw the needle 70 from the gasket 36, the material of the gasket closing resiliently upon itself to seal the puncture caused by the needle. The container/dispenser 24 will next be manually shaken to mix the catalyst ingredient throughout the product mass 22 whereupon the urethane will be ready to be dispensed as a foam. After the dispensing has been completed, the injector apparatus 20 and the container/dispenser 24 may be discarded.

The drawings and the foregoing descriptions are not intended to represent the only form of the invention in regard to the details of its construction and manner of operation. Changes in the form and in the proportion of parts and in the nature of the product ingredients involved, as well as the substitution of equivalents, are contemplated as circumstances may suggest or render expedient; and although specific terms have been employed, they are intended in a generic and descriptive sense only and not for the purposes of limitation, the scope of the invention being delineated in the following claims.

The invention is claimed as follows:

1. Apparatus for injecting a product ingredient into a pre-filled product container having superatmospheric internal pressure and having an aperture sealed with a resilient, pierceable gasket, said apparatus comprising: a coupling member including cavity means for snugly receiving a portion of the container body to establish a datum aligned with said pierceable gasekt, said coupling member further including mounting means for positioning a syringe assembly; a syringe assembly including a tubular barrel mounted on said mounting means and defining an internal chamber for containing a metered quantity of a liquid product ingredient, said syringe assembly further including a cannulated needle fastened to said tubular barrel in fluid-transfer relationship with said product ingredient chamber and alignable confronting the pierceable gasket, and a movable piston in said barrel; a wrench member assemblable with said coupling member and including actuator means for selectively engaging said piston in reducing the internal volume of said product ingredient chamber; and progressively engagable, force-multiplying means acting between said coupling member and said wrench member for cooperating in support of said syringe assembly upon advance of said needle into piercing engagement with said gasket and for urging said actuator means into operative engagement with said piston to express the contents of said ingredient chamber through said needle and into said product container against the internal backpressure thereof.

2. Apparatus according to claim 1 wherein said force-multiplying means comprises internal screw thread means disposed on one of said coupling member and said wrench member, and external screw thread means progressively interengagable with said internal screw thread means and disposed on the other of said coupling member and said wrench member.

3. Apparatus according to claim 1 which further comprises a resilient toroidal sealing member acting between said piston and the confronting internal wall of said product ingredient chamber.

4. Apparatus according to claim 1 which further comprises tamperproof, ratchet-and-pawl means acting between said coupling member and said wrench member whereby to resist and provide an indication of unwanted reversing out of said wrench member relative to said coupling member.

5. Apparatus according to claim 1 which further comprises tubular stop structure means disposed on said coupling member axially aligned with and surrounding said needle to form a guard, said stop structure means including an end lip confrontable with a selected region of said container body encompassing said gasket to define a mechanical stop.

6. Apparatus according to claim 5 wherein said tubular stop structure further includes sealing gasket means on said end lip.

7. Apparatus according to claim 1 which further comprises cement means for positively fixing said needle to said barrel.

8. Apparatus according to claim 1 wherein said chamber includes a conical portion adjacent said needle and wherein said piston includes a complementary conical tip.

9. Apparatus according to claim 1 wherein said piston includes a tail post and wherein said actuator means includes a complementary shaped recess for receiving said post in rotatable relationship.

10. Apparatus according to claim 1 wherein said coupling member and said wrench member include external knurled surface means for facilitating manual relative rotation of said members in injecting the product ingredient into the product container.

11. Apparatus according to claim 1 wherein said coupling member and said wrench member include respective slidably and rotatably telescopingly assemblable cylindrical wall means for maintaining axial alignment of said members.

12. Apparatus for injecting a product ingredient into a pre-filled product container having superatmospheric internal pressure, said apparatus comprising: a coupling member including cavity means for snugly receiving a portion of the container body to establish alignment therewith, said coupling member further including mounting means for positioning a syringe assembly with respect to a pierceable portion of said container body; a syringe assembly including a syringe body mounted on said mounting means and defining an internal chamber for containing a metered quantity of a fluid product ingredient, said syringe assembly further including a cannulated needle fastened to said syringe body in fluid-transfer relationship with said product ingredient chamber; a wrench member assemblable with said coupling member and including actuator means for selectively engaging said syringe assembly in reducing the internal volume of said product ingredient chamber; and force-multiplying means acting between said coupling member and said wrench member for urging said actuator means to express the contents of said ingredient chamber through said needle and into said product container against the internal backpressure thereof.

* * * * *